US005330056A

United States Patent [19]

de la Rocha

[11] Patent Number: 5,330,056

[45] Date of Patent: Jul. 19, 1994

[54] PACKAGE FOR COSMETIC ARTICLES

[76] Inventor: Daniel de la Rocha, 6303 SW. 42 St., Miami, Fla. 33155

[21] Appl. No.: 63,884

[22] Filed: May 18, 1993

[51] Int. Cl.[5] ..... B65D 69/00

[52] U.S. Cl. ..... 206/581; 206/229; 206/362; 206/804; 132/297; 132/315; 132/318

[58] Field of Search ..... 206/361, 362, 210, 229, 206/523, 581, 804; 132/293, 297, 304, 314, 315, 317, 318

[56] References Cited

U.S. PATENT DOCUMENTS

| | | | |
|---|---|---|---|
| 2,474,166 | 6/1949 | Rumsey, Jr. | 206/804 |
| 2,988,209 | 6/1961 | Parrilla | 206/362 |
| 3,589,505 | 6/1971 | Burnski | 206/804 |
| 4,201,290 | 5/1980 | Madden | 132/314 |
| 4,526,273 | 7/1985 | Tsuji et al. | 206/581 |
| 4,687,009 | 8/1987 | Van Buuren | 206/362 |
| 4,714,160 | 12/1987 | Bennett | 206/362 |
| 5,092,354 | 3/1992 | Pacelli, Jr. | 132/315 |
| 5,163,457 | 11/1992 | Lombardi, Jr. | 132/304 |

*Primary Examiner*—David T. Fidei
*Attorney, Agent, or Firm*—Malloy & Malloy

[57] ABSTRACT

A box with a top lid hingedly attached thereto and a carrier movably disposed within an interior of the box and structured to hold cosmetic articles in a predetermined arrangement such that the cosmetic articles can be removed from within the box. A ribbon is attached to the box at one end with an opposite free distal end of the ribbon extending from the box interior. Pulling on the free end causes the ribbon to engage the carrier, forcing the carrier upwardly from a lowered, stowed position to a raised position, facilitating access to the cosmetic articles held by the carrier.

9 Claims, 2 Drawing Sheets

PACKAGE FOR COSMETIC ARTICLES

FIELD OF THE INVENTION

The present invention relates to a package for containing cosmetic articles therein, including such articles as lipstick applicators, perfumes, rouge, and the like.

BACKGROUND OF THE RELATED ART

Most women use a variety of cosmetic products daily, including such cosmetic products as lipstick, rouge, blush, eyeliner, and perfume. Commonly, women will carry at least some of these cosmetic products in their purse so that they may replenish their makeup during the course of the day. In most instances, the individual cosmetic articles are carried loosely in one's purse or in a smaller cosmetic pouch which is carried in the purse. The problem with carrying cosmetics in this manner is that when it is desirous to use any one product, a woman must fumble through her purse or cosmetic pouch for the item she needs. Additionally, some cosmetic items are difficult to carry loosely in a purse without damaging the cosmetic article and/or the inside of the purse. A specific example of this is sample lipstick applicators, and particularly cotton swab applicators which are coated at one end with rouge. In this particular instance, if this type of sample lipstick applicator were carried loosely, the rouge coated end would most likely come into contact with other articles in the purse, as well as the purse, damaging both the sample applicator and anything it should happen to come in contact with.

Accordingly, in view of the problems associated with carrying various cosmetic articles, it would be of great benefit to provide a package or container which is specifically designed to contain cosmetic articles, such as swab-type lipstick applicators, in a neat, organized fashion, such that individual articles may be easily and conveniently retrieved therefrom and replaced as needed.

SUMMARY OF THE INVENTION

The present invention is directed to a package for containing cosmetic articles therein, such as lipstick applicator swabs, perfume or fragrance containers, rouge containers, eyeliner pencils, and other like cosmetic articles. The package consists of a box with a top lid hingedly attached thereto and moveable between an open and closed position to facilitate access to an interior of the box. A sample carrier is movably disposed within the box interior and is structured to hold the cosmetic articles in a predetermined arrangement such that the articles may be easily identified and removed from within the box without damaging the cosmetic articles or the container.

Means are provided within the box for moving the sample carrier between a lowered, stowed position wherein the top lid may be closed, and a raised position, with the lid open facilitating access to the cosmetic articles contained therein.

The package of the present invention is ideally suited to contain lipstick applicator swabs in spaced relation therein, preventing damage to the rouge coated ends. With this in mind, it is contemplated within the spirit and scope of the present invention that a specific lipstick applicator swab be used in combination with the package. The lipstick applicator swab of the present invention would include a generally elongate stick made of wood, plastic or other suitable material and including at least one end having a fibrous cotton bulb adhered thereto. During manufacture, the cotton bulb is dipped in wax, such as beeswax or paraffin wax. Subsequently, the wax coated cotton end is dipped in rouge so as to coat the previously wax coated end of the applicator with the rouge. The wax coating under the rouge provides a smooth surface to receive the rouge coating, while also preventing the cotton fibers from being released during application of the rouge on the lips of the user.

With the foregoing in mind, it is a object of the present invention to provide a package for containing various cosmetic articles therein in a neat, predetermined arrangement, facilitating quick and convenient access to individual ones of the cosmetic articles as needed.

It is a further object of the present invention to provide a package for containing cosmetic articles therein, and specifically lipstick applicator swabs in a predetermined, spaced arrangement in such a manner so as to prevent damage to the lipstick coated on the end of the swab applicator.

It is yet a further object of the present invention to provide a unique, attractive, novelty package for containing various cosmetic articles therein.

These and other objects of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the various views of the drawings.

DETAILED DESCRIPTION OF THE PREFERRED EMBODIMENT

Figure 1:
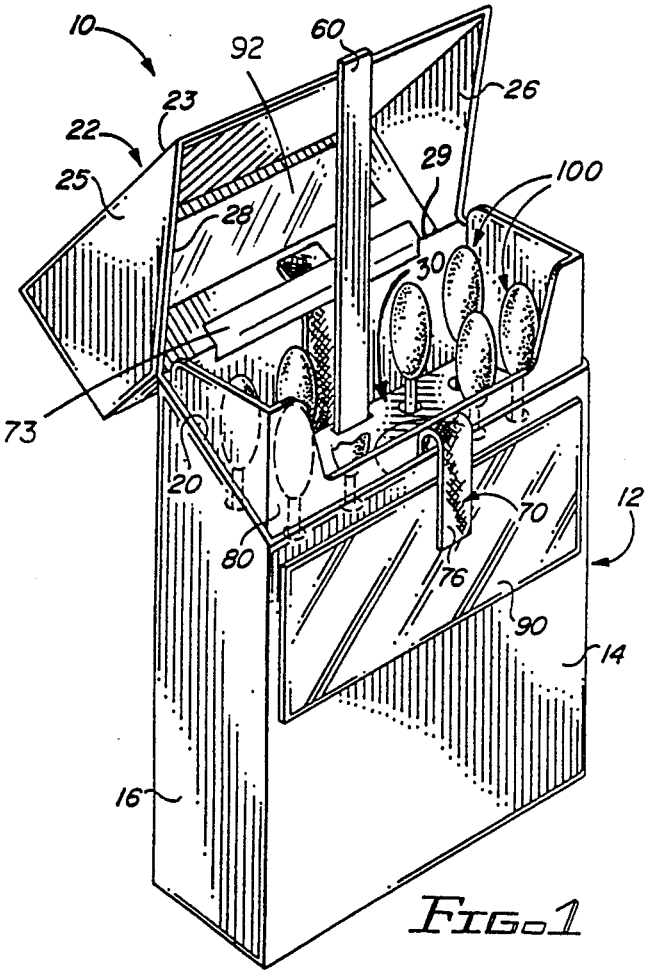
FIG. 1 is a perspective view of a preferred embodiment of the present invention.
Figure 2:
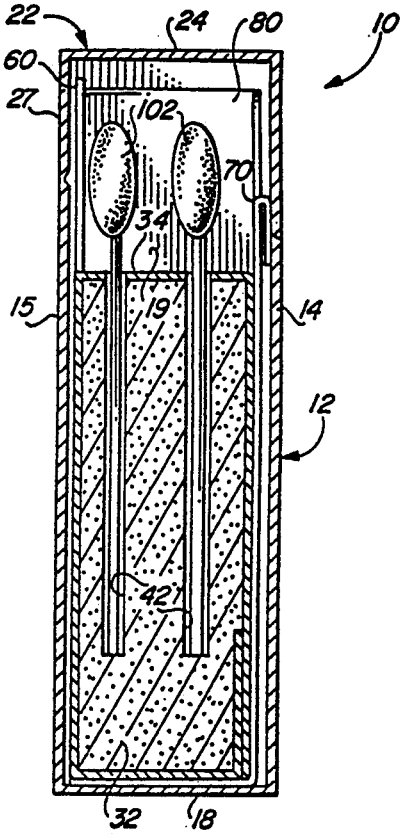
FIG. 2 is a sectional view of the embodiment of FIG. 1.

Referring to the various figures, and initially FIGS. 1 and 2, there is illustrated the package of the present invention, generally indicated as 10. The package 10 includes a box 12 having a front wall 14, a rear wall 15, opposite side walls 16 and 17 (see FIG. 4), and a bottom 18. The box 12 further includes an interior 19 surround by a top edge 20 defining an opening, facilitating access to the interior 19.

A top lid 22 is hingedly attached to the box 12 at 29 along the top edge 20 of the box 12. The top lid includes a front face 23, an upper surface 24, opposite sides 25 and 26, and a back 27. A bottom edge 28 of the lid is specifically structured and disposed for mating engagement with the top edge 20 when the lid is in a closed position.

Figure 3:
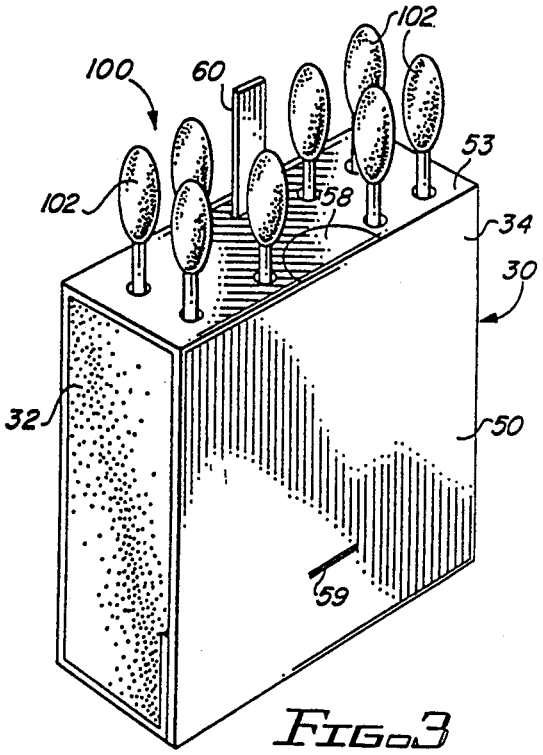
FIG. 3 is a perspective view and a component of the embodiment of FIG. 1.
Figure 5:
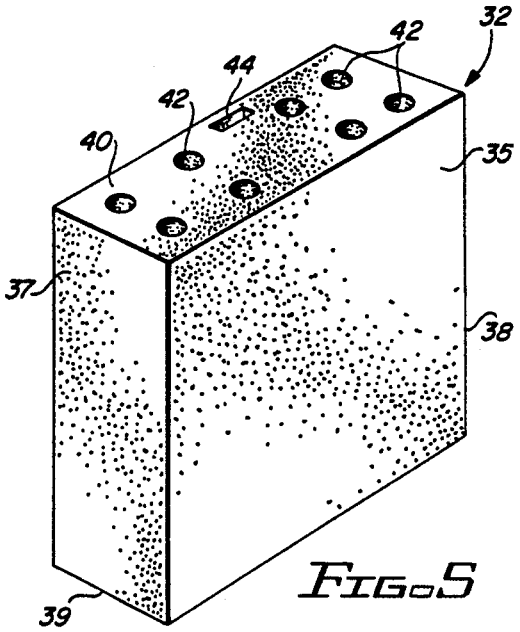
FIG. 5 is a perspective view of another component, in detail of the embodiment of FIG. 3.
Figure 6:
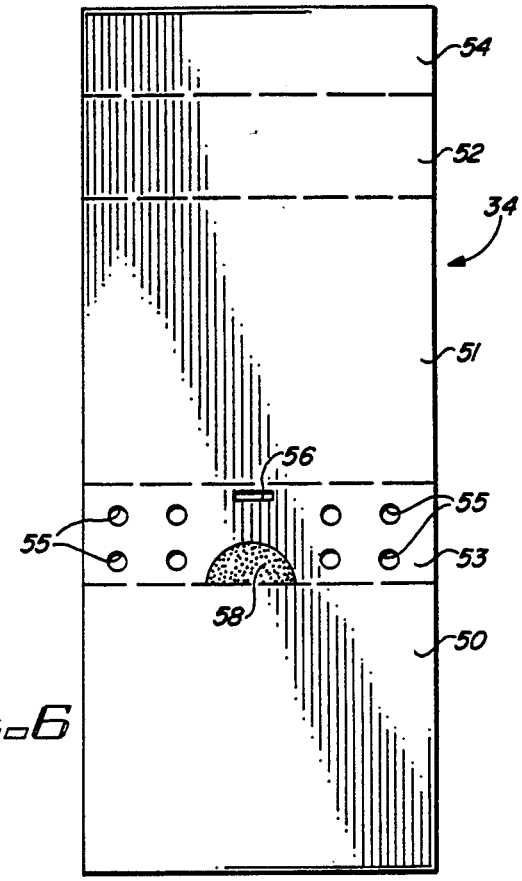
FIG. 6 is a front view of another component of the embodiment of FIG. 3.

A carrier assembly 30 is disposed within the interior 19 of the box 12. The carrier assembly 30 is specifically structured to hold cosmetic articles 100 such as lipstick applicator swabs 102. The sample carrier assembly is best illustrated in FIGS. 3, 5 and 6 and includes an interior core 32 (see FIG. 5) and an outer cover 34 (see FIG. 6). The interior core includes a front face 35, a rear face 36 (not shown), opposite sides 37, 38, and a bottom 39. The interior core 32 of the carrier assembly 30 further includes a top face 40 having a plurality of receiving channels formed therein including channels 42 specifically structured and arranged for receipt of individual cosmetic sample articles therein. The top face 40 of the interior core 32 further includes a slot 44 which is structured and disposed for receipt of a stop member 60 (to be described more fully hereinafter) therein.

Figure 7:
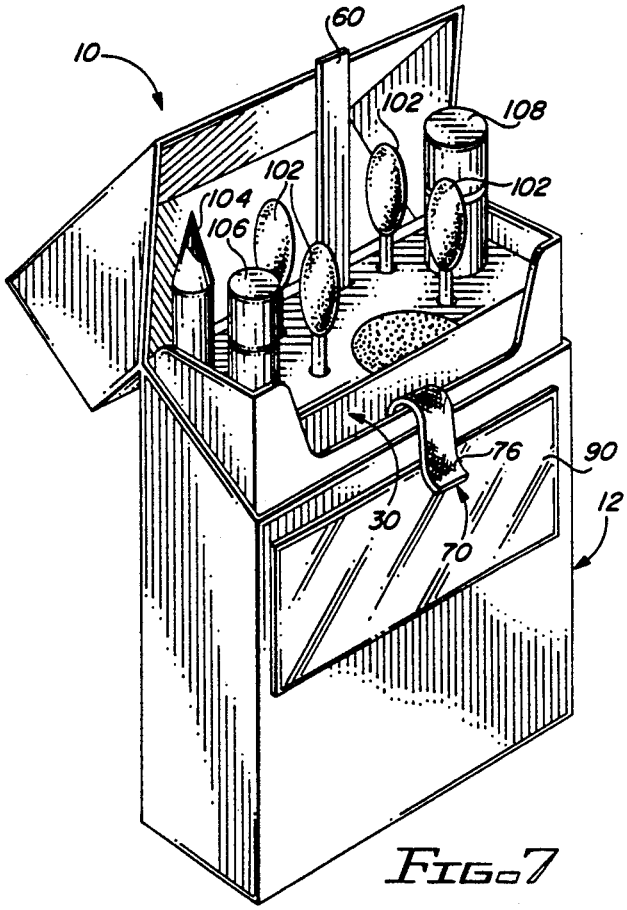
FIG. 7 is a perspective view of the embodiment of FIG. 1 in a different, raised position.
Figure 8:
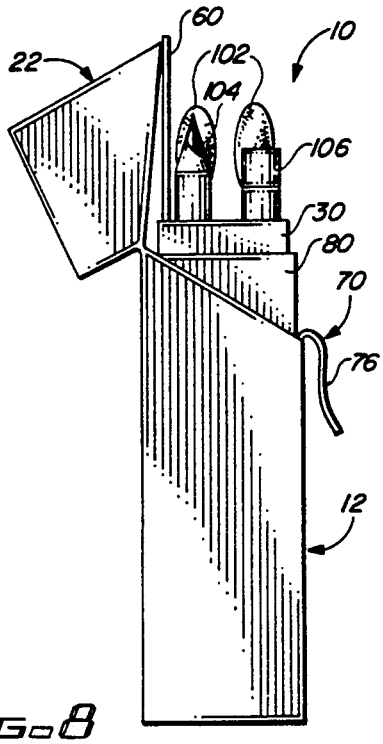
FIG. 8 is a side view of the embodiment of FIG. 7.

With reference to FIG. 6, the outer cover 34 of the sample carrier assembly 30 includes a front panel 50, a rear panel 51, a bottom panel 52, a top panel 53, and a tab portion 54. The outer cover 34 is specifically designed to cover the front, rear, top and bottom faces of the interior core 32, as shown in FIG. 3, such that the outer cover 34 is disposed in sliding engagement with an inner surface of the front and rear walls 14, 15 of the box interior 19. The top panel 53 of the outer cover 34 is provided with a plurality of openings formed therethrough including apertures 55 specifically sized and positioned for mating alignment with the channels 42 in the interior core 32. A cutout 56 is further provided on the top panel 53 for alignment with the slot 44 such that the stop member 60 may extend outwardly therefrom, as best seen in FIGS. 1, 7 and 8. The top panel 53 of the cover 34 may further be provided with a marking 58 defining a press zone to facilitate forced downward movement of the carrier within the interior of the box 12 by pressing thereon with one's finger. The cover 34 is specifically designed to be fitted about the interior core 32 and secured in place with use of a conventional staple 59 or like fastener.

Figure 4:
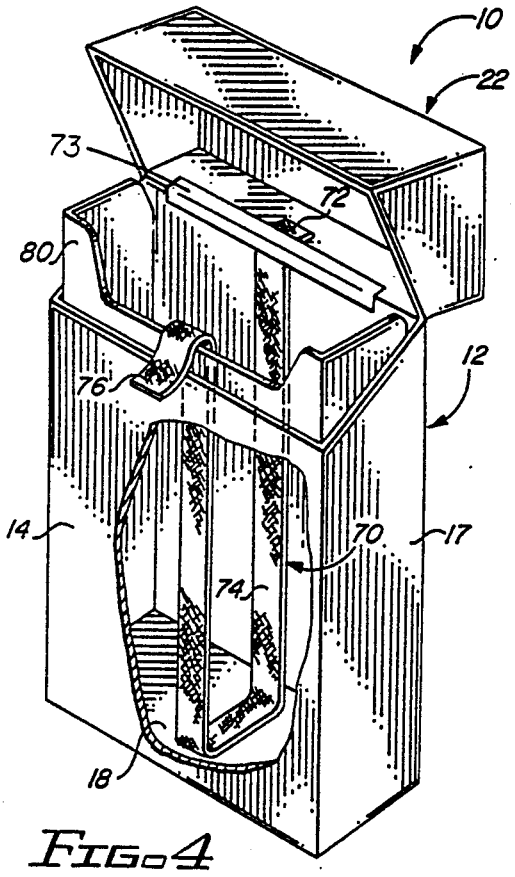
FIG. 4 is a perspective view of a portion of the embodiment of FIG. 1.

The present invention is further provided with carrier movement means including a ribbon 70 having a first end 72 fixedly secured to an inner surface of the box interior 12 by a suitable adhesive means. In a preferred embodiment, a strip of tape 73 is applied along the hinged attachment 29 to reinforce the hinge, preventing tearing, while also attaching the first end 72 of the ribbon to the inner surface of the lid 22. The ribbon 70 includes a mid-portion 74 which is draped down within the interior 19 of the box 12 with a free distal end 76 extending out through the top opening of the box 12, as shown in FIG. 4. In this manner, the mid-portion 74 of the ribbon would extend about the carrier assembly 30 along the front 35, rear 36, and bottom 39 thereof. To move the carrier assembly upwardly, the free distal end 76 of the ribbon 70 would be grasped and pulled gently such that the mid-portion 74 urges the carrier assembly 30 upwardly until the cosmetic samples 100 contained therein are easily accessible through the open top of the box 10. In use, the distal end 76 of the ribbon would be pulled, while maintaining the lid 22 open until the stop member 60 has risen to a sufficient height to block the lid 22 preventing it from closing, as shown in FIGS. 1, 7 and 8. In this manner, the top lid is maintained in the open position so as to prevent interference with the retrieval of the cosmetic samples 100.

A reflective mirror 90 may be provided on the outer exposed surface of the front wall 14. Alternatively or additionally, the mirror 90 could be provided on virtually any surface of the package 10, including a mirror 92 on the under side surface of the top lid 22. The mirror 90 may be formed of a highly reflective metallic film such as Mylar®, a registered trademark having a reflective, mirror-like finish, or virtually any other suitable reflective material which would enable a user to view their facial features while applying the cosmetic products. The mirror 92 on the under side surface of the lid 22 may also be of a Mylar material, or alternatively, a thin acrylic material having a reflective mirror finish.

It is contemplated that various cosmetic sample articles may be used in combination with the package 10 of the present invention including lipstick applicator swabs 102. As shown in FIGS. 7 and 8, a variety of cosmetic sample articles 100 may be carried within the package including the lipstick applicator swabs 102, an eyeliner pencil 104, a perfume or fragrance container 106, as well as a blush container 108 or other like cosmetic articles.

What is claimed is:

1. A package for containing cosmetic articles therein comprising:

a container including a bottom, a front wall, a rear wall, and opposite side walls, all having inner and outer surfaces, and an open top disposed in communication with an interior of said container, said container further including a lid disposed for placement in covering relation to said interior of said package on said open top, carrier means movably disposed within said interior for holding said cosmetic articles in a predetermined arrangement, said carrier means being movable within said interior between a lowered, stowed position, and a raised position, said raised position facilitating retrieval of the cosmetic articles through said open top, movement means for moving said carrier means between said lowered, stowed position and said raised position, said lid hingedly attached along an upper edge of said rear wall and movable between an open position and a closed position in covering relation to said open top, said carrier means including a carrier including a central core having a top face, a bottom face, a front face, a rear face, and opposite side faces, said central core including a plurality of channels formed therein, each of said channels including an open end at said top face of said central core, and being structurally adapted to removably receive one of the cosmetic articles therein such that a portion of each of the cosmetic articles extend from said top face and outwardly from said open top of said container when said carrier means is in said raised position, and said sample carrier further including an outer cover disposed in overlying relation to said top face, said bottom face, said front face, and said rear face of said central core.

2. A package as set forth in claim 1 wherein said outer core of said sample carrier is structured and disposed for sliding engagement with said inner surface of said front and rear wall of said container.

3. A package as set forth in claim 2 wherein said outer covering includes a top panel structured and disposed for overlying engagement with said top face of said central core and including a plurality of apertures formed therein arranged and configured for congruent alignment with said open ends of said channels in said central core.

4. A package as set forth in claim 3 wherein said movement means includes a ribbon having a first distal end attached to said carrier, a second free distal end extending outwardly through said open top, and a mid-portion disposed within said container interior and structured to engage said sample carrier upon application of an external pulling force to said second free distal end, causing said sample carrier to be urged upwardly within said container interior towards said open top.

5. A package as set forth in claim 1 further including stop means for maintaining said lid in said open position when said sample carrier means is in said raised position.

6. A package as set forth in claim 1 further including reflective means on said container having a mirror finish adapted for viewing of reflected images therein to facilitate application of makeup using said cosmetic articles.

7. A package as set forth in claim 6 wherein reflective means includes a metallic film material adhered to said container such that a highly reflective surface thereof is exposed.

8. A package as set forth in claim 6 wherein said reflective means is formed of an acrylic material having a highly reflective finish on an exposed surface thereof.

9. A package as set forth in claim 8 wherein said acrylic material is adhered to an under side surface of said lid.

* * * * *